US006048234A

United States Patent [19]

Uematsu et al.

[11] Patent Number: 6,048,234

[45] Date of Patent: Apr. 11, 2000

[54] HYDRAULIC TILT AND TRIM UNIT FOR MARINE DRIVE

[75] Inventors: Yoshikatsu Uematsu; Naoyoshi Kuragaki; Kazuya Takeuchi, all of Shizuoka, Japan

[73] Assignee: Yamaha Hatsudoki Kabushiki Kaisha, Japan

[21] Appl. No.: 09/036,741

[22] Filed: Mar. 9, 1998

[30] Foreign Application Priority Data

Mar. 7, 1997 [JP] Japan ..... 9-053593

[51] Int. Cl.[7] ..... B63H 20/10

[52] U.S. Cl. ..... 440/1; 440/61

[58] Field of Search ..... 440/61, 1

[56] References Cited

U.S. PATENT DOCUMENTS

| | | | |
|---|---|---|---|
| 3,799,104 | 3/1974 | Kurling | 440/61 |
| 3,842,789 | 10/1974 | Bergstedt . | |
| 4,064,824 | 12/1977 | Hall et al. | 440/61 |
| 4,457,725 | 7/1984 | Kern et al. | 440/61 |
| 4,778,414 | 10/1988 | Taguchi . | |
| 4,813,896 | 3/1989 | Koike et al. . | |
| 5,007,866 | 4/1991 | Okita . | |
| 5,018,994 | 5/1991 | Okita . | |
| 5,067,919 | 11/1991 | Okita . | |

FOREIGN PATENT DOCUMENTS

| | | | |
|---|---|---|---|
| 62-83298 | 4/1987 | Japan | 440/61 |
| 4-63795 | 2/1992 | Japan | 440/61 |

*Primary Examiner*—Sherman Basinger
*Attorney, Agent, or Firm*—Knobbe, Martens, Olson & Bear, LLP

[57] ABSTRACT

An improved flow control mechanism for a tilt and trim adjustment systern quickens tilt operation of an associated outboard drive, without sacrificing a desired control when trimming the outboard drive. The flow control mechanism includes a bypass line that interconnects the two sides of a respective tilt and trim cylinder. A bypass valve regulates flow through the bypass line. The bypass valve opens the bypass line when moving the outboard drive within the tilt range to quicken this operation. When moving the outboard drive within the trim range, however, the bypass valve closes the bypass line and connects an up chamber of the cylinder to a suction side of the pump to slow the speed at which the tilt and trim adjustment systern moves the outboard drive within this range of movement. The slower speed by which the systern raises and lowers the outboard drive enhances the ability to control the adjustment of the outboard drive's trim position. An actuator mechanism automatically controls the valve depending upon whether the drive's movement occurs within the tilt range or the trim range.

34 Claims, 5 Drawing Sheets

HYDRAULIC TILT AND TRIM UNIT FOR MARINE DRIVE

BACKGROUND OF THE INVENTION

1. Field of the Invention

This invention relates to a marine propulsion unit for a watercraft, and more particularly to a hydraulic tilt and trim adjustment system for a marine propulsion unit.

2. Description of Related Art

Stern drive units often propel both leisure and commercial boats. In general, owners and operators of leisure boats want easy and precise control over trim adjustment in order to maximize performance and handling characteristics of the boat.

The optimal trim angle of stern drive varies with a boat's running condition. For instance, the bow of the boat should press against the water when accelerating from rest or from a slow speed. To achieve this condition, the angle of the propeller shaft is disposed at a slightly negative angle relative to the horizontal (i.e., at a negative trim angle). A thrust vector produced by the propeller in this position is thus out of the water. When running at high speed, the propeller is raised or trimmed to position the propeller shaft at a positive trim angle relative to the horizontal within the range of about 0° to 15°. The outboard drive also must be raised beyond the normal trim range in order to operate in shallow water, to avoid underwater articles and for storage in a full tilt-up position.

In commercial applications, such as for fishery use, boat operators desire a quick tilt-up function for the stern drive. Fast tilt-up of the drive is required to rapidly place the drive's propeller out of the water to avoid nets and the like, which float on the water surface.

A hydraulic tilt and trim adjustment system often adjusts the trim and tilt position of the stern drive. The tilt and trim adjustment system usually includes at least one hydraulic actuator which essentially operates between the boat transom and the stern drive unit. The actuator causes the stern drive to pivot about a horizontal axis to raise or lower the drive's unit.

Tilt and trim adjustment systems also usually employ a hydraulic motor that effects the trim and tilt operations of the outboard drive. For this purpose, prior hydraulic motors have included a reversible electric motor that selectively drives a reversible fluid pump. The pump pressurizes or depressurizes the hydraulic actuator for raising or lowering the stern drive.

The pressure in the actuator required to move the stern drive varies greatly depending on whether the propulsion unit is operating in a trim range or in a tilt range. In a tilt range, usually associated with tilting the propulsion unit out of the water, the pump generates a relatively low pressure in the actuator because only the drive unit loads the actuator.

The pump conversely must generate far greater pressure to trim-up the stern drive because of the load placed on the unit by the propulsion unit. The increase in load results from the thrust of the propulsion unit. That is, a portion of the thrust produced by the propulsion unit acts downward and against the tilt and trim mechanism when trimming up. Higher pressures therefore are required in the actuator to trim up the drive when running at high speeds (e.g., at planning speeds). When used with leisure boats (e.g., ski boats, sport boats, run-abouts, and the like), the tilt and trim adjustment systems are designed to trim the outboard drive relatively slowly to prevent drive "pop-up."

Undesirable drive pop-up occurs because the thrust of the propulsion system suddenly decreases as the motor is swung from the trim range into the tilt range. Within the tilt range, the large pressure built-up within the actuator, which was opposed by the drive's thrust in the trim range, rapidly pushes the actuator arm upward and causes the stern drive to pop-up quickly. Tilt and trim mechanisms used on leisure boats thus limit trim and tilt-up speed.

As noted above, however, it often is desirable in commercial applications to quickly raise the stern drive in order to avoid underwater articles, such as, for example, fishing nets and the like. The hydraulic circuitry employed with tilt and trim mechanisms used in commercial applications therefore permits the stern drive to be raised quickly.

Because of the differences in the design of the hydraulic circuitry, it previously has not been easy to convert a tilt and trim adjustment system for commercial applications. Prior drive units also have not been designed to exhibit the trim and tilt adjustment characteristics necessary to make the drives acceptable for use in both leisure and commercial applications.

Prior attempts to provide such a versatile tilt and trim adjustment system have suffered from several drawbacks. For instance, U.S. Pat. No. 3,842,789 discloses a valve system which permits quick tilt and trim movement of an outboard drive unit; however, this system requires the manual control of a remote operator in order to actuate the valve and quickly raise the outboard drive. Actuation of the valve occurs upon operation of a shift control mechanism. The control of the drive system does not differentiate between movement within the tilt and trim ranges, only the drive direction (e.g., forward/reverse).

Other methods have been proposed to quicken the operational speed of the tilt and trim adjustment system. One such approach involved reducing the cylinder diameter of the actuator. Although this approach quickened the tilt-up speed of the mechanism, it failed to maintain certain trim angles when running at high speeds or under large loads. It also did not provide the shock-absorbing function conventionally provided by prior hydraulic adjustment system when the drive strikes a floating object.

Another approach involved increasing the fluid flow volume from the hydraulic pump. Although this may quicken the operational speed of the hydraulic system, it requires almost all new parts, increasing either the costs associated with fabrication or retrofit.

SUMMARY OF THE INVENTION

A need therefore exists for a simply structured modification to known hydraulic circuit designs which increases the operational speed during upward movement within a tilt range, provides precise control and adjustment during upward movement within a trim range, and does not substantially increase manufacturing costs or costs associated with retrofitting an existing drive unit.

An aspect of the present invention thus involves a tilt and trim adjustment system for an outboard drive. As used herein, the term "outboard drive" means a stern drive of an inboard/outboard propulsion system, an outboard motor or a like marine drive unit. The tilt and trim adjustment system comprises at least one cylinder that is connected to the outboard drive and that includes first and second chambers. A reversible pump is connected to each of the first and second cylinder chambers to supply pressurized working fluid to the cylinder chambers. A bypass line interconnects the first and second cylinder chambers independent of the pump, and a bypass valve operates between the cylinder chambers and communicates with the bypass line. So arranged, the bypass valve selectively permits fluid communication between the cylinder chambers through the bypass line. The bypass valve operates between at least a first operational state, in which the bypass valve permits fluid flow through the bypass line, and a second position, in which the bypass valve arrests fluid flow through thebypass line. An acrustor mechanism is coupled to the bypass valve and automatically moves the bypass valve into one of the two positions depending upon a tilt/trim angle of the outboard drive.

In some applications, the bypass valve permits communication between the cylinder chambers via the bypass line when raising or lowering the outboard drive within a tilt range to increase the tilt-up or tilt-down speed of the outboard drive. As a result, operation of the adjustment system is quickened within this range. The bypass valve also closes the bypass line when operating within the trim range in order to enhance ease and precision to trim angle adjustments within this range. The present tilt and trim adjustment system consequently allows the outboard drive to exhibit features desirably in both leisure and commercial applications, adding versatility to the boat on which it is employed.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of preferred embodiments of the present tilt and trim adjustment system. The illustrated embodiments are intended to illustrate, and not to limit the invention. The drawings contain the following figures.

DETAILED DESCRIPTION OF PREFERRED EMBODIMENT OF THE INVENTION

Figure 1:
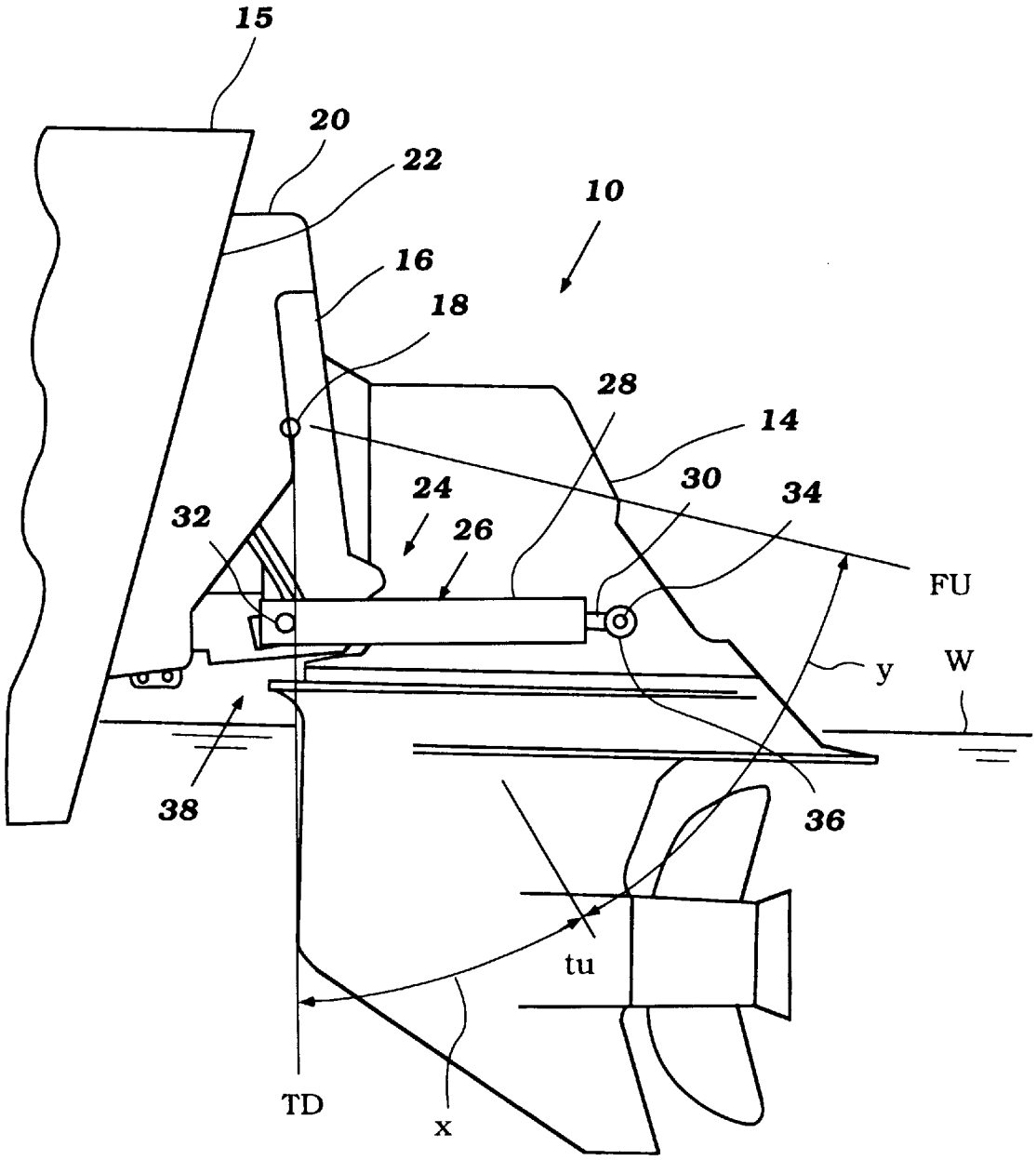
FIG. 1 is a side elevational view of a stern drive, which includes a hydraulic tilt and trim adjustment mechanism configured in accordance with a preferred embodiment of the invention. The stern drive is illustrated as attached to a transom of an associated watercraft.

FIG. 1 illustrates a marine outboard drive 10 together with a trim and tilt adjustment system 12 that is configured in accordance with a preferred embodiment of the present invention. In the illustrated embodiment, the outboard drive 10 is depicted as a stern drive unit of an inboard-outboard motor. It is contemplated, however, that the present invention can be used with outboard motors as well. Accordingly, as used herein and as noted above, the term "outboard drive" shall include stern drives, outboard motors, and similar marine drive units.

The stern drive unit 10 illustrated in FIG. 1 is exemplary. An outer housing 14 of the stern drive 10 is connected to a gimbal housing 16, that encloses a conventional gimbal ring. The gimbal ring connects the stern drive housing 14 to the watercraft 15 and allows the stern drive 10 to rotate about a vertical axis for steering purposes, as well as to pivot about a lateral axis 18 to tilt and trim the stern drive 10, as known in the art. The gimbal ring and housing 16 are attached to a stern plate 20, which in turn is mounted onto a transom 22 of the watercraft 15.

The tilt and trim adjustment system 12 desirably includes a hydraulic motor assembly, indicated generally by reference numeral 24. In the illustrated embodiment, the hydraulic motor assembly 24 includes a pair of tilt and trim cylinders 26 that extend between the stern drive outer housing 14 and the gimbal housing 16. Each cylinder 26 includes a cylinder body 28 in which a piston slides. An actuator arm 30 is attached to the piston and extends beyond one end of the cylinder body 28. A conventional pivot connection 32 couples the body 28 of each cylinder 26 to the gimbal housing 16, and another conventional pivot connection 34 couples a tunnion 36 at the end of the actuator arm 30 to the outer housing 14 of the stern drive unit 10.

A powering assembly of the tilt and trim adjustment system 12, which is indicated generally by reference numeral 38, powers the cylinders 26 to raise and lower the stern drive unit 10. The powering assembly desirably includes a reversible electric motor (not shown), which drives a reversible pump 40 (FIG. 2), and a flow control mechanism that control the flow of working fluid (e.g., hydraulic fluid) to and from the cylinders 26. The flow control mechanism desirably is conveniently located on an underside of the gimbal ring housing 16 with the pump and motor located within the hull of the watercraft 15.

As noted above, the tilt and trim adjustment system 12 operates between the gimbal housing 16 and the outer housing 14 of the drive unit 10 to effectuate the tilt and trim movement of the outboard motor 10. As a result of the pivotal connection provided by the gimbal ring, the tilt and trim adjustment system 12 can move the outboard motor 10 through a trim range X between a fully trimmed-down position (TD) and a fully trimmed-up position (TU). The fully trimmed-up position (TU) illustrated in FIG. 1 represents the position of the leading edge of the stern drive's lower unit when moved to this position. The tilt and trim adjustment system 12 can also move the outboard motor 10 through a tilt-up range Y between the fully trimmed-up position (TU) and a full tilt-up position (FU). The full tilt-up position (FU) illustrated in FIG. 1 represents the position of the leading edge of the stern drive's lower unit when moved to this position.

Figure 2:
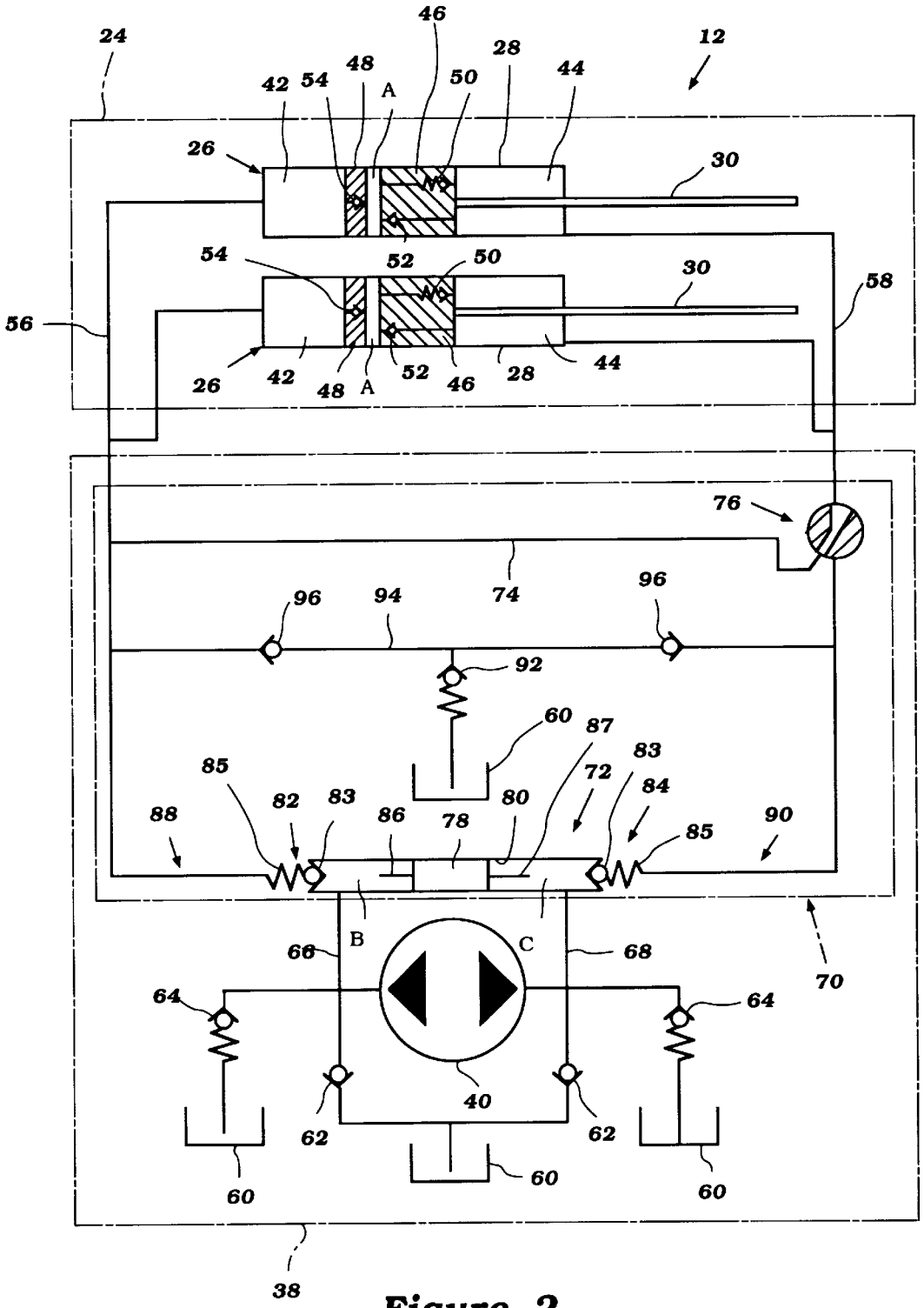
FIG. 2 is a schematic drawing of a hydraulic circuitry of the tilt and trim adjustment system of the present invention.

The tilt and trim adjustment system 10 will now be described with additional reference to FIGS. 2 through 5. FIG. 2 schematically illustrates the internal construction of the cylinders 26 of the hydraulic motor assembly 24. The body 28 of each cylinder forms two variable-volume chambers on either side of the piston. One chamber, an up chamber 42, is defined to a side of the piston opposite of the actuator rod 30, while the other chamber, a down chamber 44, is defined to the same side of the piston as the actuator rod 30. The actuator rod 30 thus extends through the down chamber 44 of the cylinder and beyond a free end of the cylinder body 28.

In the illustrated embodiment, the motor assembly 24 desirably provides hydraulic damping, in addition to tilt and trim adjustment of the stern drive unit 10. The damping or shock-absorbing operation allows the drive unit 10 to pop-up if it strikes an underwater object so as to prevent damage. This feature is achieved by providing a compound piston formed by an active piston 46 and a free piston 48. The active piston 46 lies adjacent to the down chamber 44 and is connected to the actuator rod 30. The free piston 48 lies adjacent to the up chamber 42. A passage is provided in the active piston to permit flow from the down chamber to a region A between the pistons. The passage includes a pressure responsive valve 50 (e.g., a check valve) that permits flow in response to a predetermined force. The amount of force necessary to open the valve 50 is set to a desired valve, as well known in the art. Return flow from the region A between the active and free pistons 46, 48 to the down chamber 44 is permitted by opening a return passage in the active piston. A one-way, pressure-relief valve 52 regulates flow through the return passage. The free piston 48 also includes a pressure relief passage that is regulated by a pressure-relief valve 54. This passage permits the flow of working fluid from the region A between the pistons 46, 48 to the up chamber 42 should the normal return passage become blocked; however, the passage in the free piston 48 normally remains closed.

During a pop-up occurrence of the stern drive 10, the free piston 48 remains stationary. By remaining in place, the free piston 48 serves as a memory device for the cylinder 26 so that the active piston 46 can return to the same trim setting as before it struck the underwater object.

The cylinders 26 of the motor assembly 24 desirably are arranged within the hydraulic circuit in parallel. That is, the up chambers 44 of the cylinders 26 are connected to a common pressure line 56, and the down chambers 44 of the cylinders 26 are connected to a common pressure line 58. In this manner, the cylinders 26 desirably move in unison.

FIG. 2 also schematically illustrates the hydraulic circuitry of the powering assembly 38 that powers and controls the hydraulic motor assembly 24. As mentioned above, the powering assembly 38 includes a reversible, positive displacement pump 40 that is driven by a reversible electric motor (not shown). The pump 40 includes a pair of inlet lines that extend from a sump 60 and in which respective non-return check valves 62 are provided. A pump relief valve 64 is provided in a line that communicates the junction of each supply line and each corresponding delivery line 66, 68 to prevent the occurrence of abnormally high pressure within the pump 40 or in the associated supply and delivery lines 66, 68. The relief valves 64 on each side of the pump 40 open into the sump 60.

A flow control mechanism, which is indicated generally by reference numeral 70, control the flow of working fluid between the cylinders 26 and the pump 40. The flow control mechanism 70 is operated by the pressure of the working fluid provided by the pump 40 in combination with a self-operating actuator described below. No manual control is required (except for operation of a manual override valve which is described below). The flow control mechanism 70 principally comprises a main valve assembly 72, which is connected to the cylinder chambers 42, 44, a bypass line 74 that is connected to the cylinder chambers 42, 44 independent of the main valve 72, and a bypass valve assembly 76. The bypass valve assembly 76 regulates flow through the bypass line 74, as described below.

The main valve assembly, indicated generally by reference numeral 72, is provided downstream of the pump 40. In the illustrated embodiment, the main valve assembly 72 comprises a shuttle-type valve and includes a shuttle piston 78 that divides an interior chamber 80 of the shuttle valve 72 into two chambers: an up chamber B and a down chamber C. The pump 40 selectively delivers pressurized fluid to the up chamber B through the first delivery line 66 and receives the working fluid from the up chamber B through this same line. The down chamber C communicates with the opposite side of the pump through the second delivery line 68.

A first check valve 82 regulates flow through a port on the shuttle valve that communicates with the up chamber 42 of each cylinder 26. In a similar manner, a second check valve 84 controls fluid flow to and from the down chambers 44 of the cylinders 26. Each check valve desirably comprise a valve disc or ball 83 that is biased against a valve seat by a biasing member 85 (e.g., a spring). The shuttle valve piston 78 has outwardly extending pin projections 86, 87 that are adapted to engage the first check valve 82 to open the first check valve 82 and adapted to engage the second check valve 84, respectively, as will become apparent.

A first pressure line 88 extends from the shuttle valve up chamber B to the lower side of the pressure line 56 connected to the up cylinder chambers 42. A second pressure line 90 connects the shuttle valve down chamber C with the second pressure line 58, which in turn is connected to the actuator cylinders 26 on a side above the respective active piston 46 and in communication with the down cylinder chamber 44.

Each pressure line 88, 90 connects to a manual override valve 92 via a common return line 94. The manual override valve 92 normally prevents fluid communication through the return line 94 to the sump 60; however, when the valve 92 is manually opened, the return line 94 places the cylinder chambers 42, 44 in communication with the sump 60. The stern drive unit 10 then can be raised or lowered manually. A back flow prevention valve 96 is placed within the return line 94 between the manual override valve 92 and each pressure line 88, 90 in order to inhibit flow between the pressure lines 88, 90 through the common return line 94.

As mentioned above, the hydraulic circuit of the powering assembly 38 includes the bypass line 74. The bypass line 74 connects together the first and second pressure lines 88, 90.

The powering assembly 38 also includes the bypass valve assembly 76 which regulates the flow of working fluid through the bypass line 74 and thus between the cylinder chambers 42, 44. The bypass valve assembly 76 in the illustrated embodiment includes a rotatable valve 96 with an internal passage 100.

Figure 3:
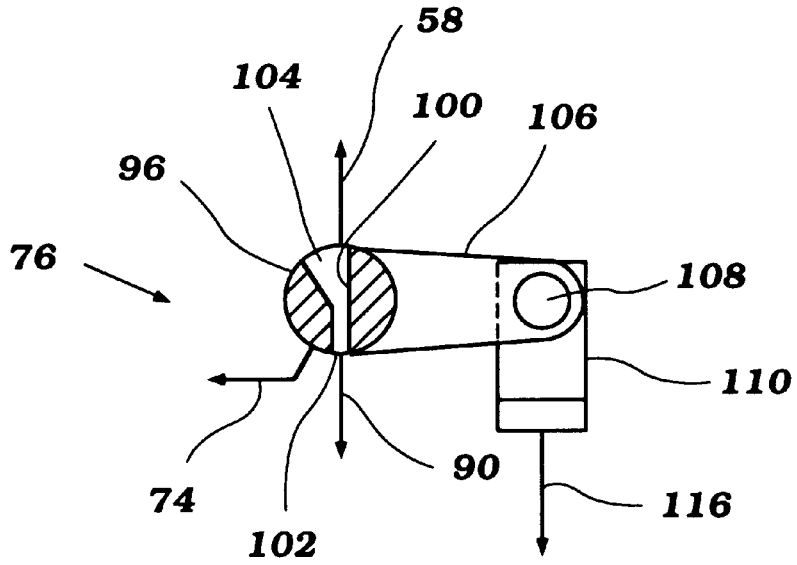
FIG. 3 is an enlarged cross-sectional view of a bypass valve assembly of the tilt and trim system schematically illustrated in FIG. 2, and illustrates the bypass valve in a first position in which an associated bypass line of the hydraulic circuit is closed.
Figure 4:
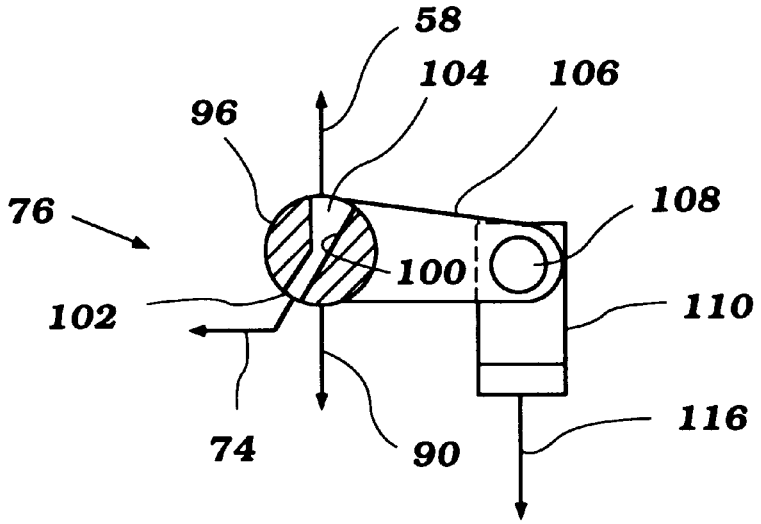
FIG. 4 illustrates the bypass valve, which is shown in FIG. 3, in a second position in which the bypass line is opened.

With reference to FIGS. 3 and 4, the internal passage 100 within the valve includes a narrow first opening 102 and a wide second opening 104. The narrow first opening 102 lies on a pump-side of the valve, while the wide second opening 104 lies on a cylinder-side of the valve. As understood from these figures, the second opening is sized to maintain communication with the pressure line 58, that communicates with the down chambers 44 of the cylinders 26, as the valve 96 toggles between two operational positions. In a first operational position, the first opening 102 communicates with the pressure line 90 (see FIG. 3), and in a second operational position, the first opening 102 communicates with the bypass line 74 (see FIG. 4). In the illustrated embodiment, the valve 96 is biased to normally lie in the first position.

A lever 106 is affixed to and extends to one side of the valve 96. A pivotal connection 108 attaches a coupler 110 to the lever 106 at an outer end of the lever 106. The pivotal connection 108 desirably lies concentrically to a radius that extends from an axis about which the valve 96 rotates. In this manner, the lever 106 effects movement of the valve 96 when actuated via the coupler 110.

Figure 5:
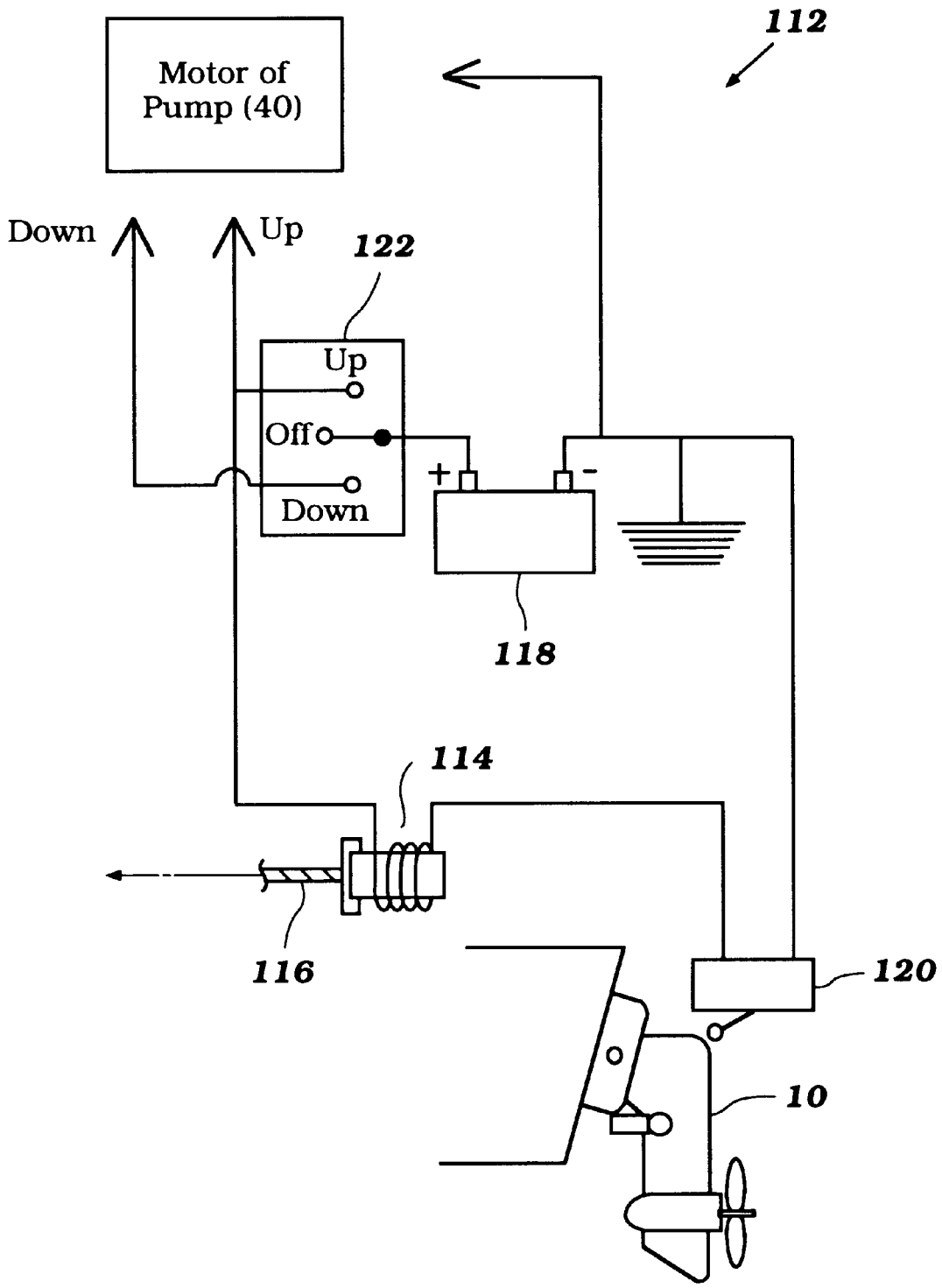
FIG. 5 schematically illustrates an actuator mechanism configured in accordance with a preferred embodiment of the present invention, and shows the actuator mechanism in use with an exemplary stern drive.

With reference now to FIG. 5, an actuator system, generally designated by reference numeral 112, causes the bypass valve 76 to toggle between the first and second positions to open and close the bypass line 74 depending in part upon the angular orientation of the stern drive 10. In the illustrated embodiment, the actuator system opens or closes the valve depending upon whether the tilt and trim actuator system 12 moves the stern drive 10 upward through the tilt range Y, or whether the actuator system 12 moves the stern drive upward through the trim range X.

The actuator system 112 include a solenoid device 114 to actuate the valve 96. As understood from FIGS. 3 and 5, a linkage 116 (e.g., a cable) connects an actual end of the solenoid 114 to the valve lever 106 via the coupler 108. The linkage 116 is configured and arranged to transmit linear movement imparted by the solenoid 114 to the coupler 106, as described below.

A power source 118 selectively energizes the solenoid device 114. In the illustrated embodiment, the power source is a DC battery. The negative terminal of the battery 118 is grounded and is connected to one side of a limit switch 120. The positive terminal of the battery 118 is connected to a trim/tilt control operator 122. In the illustrated embodiment, the operator 122 comprises a single throw, double pole switch with a center off position. One of the poles is connected to one side of the solenoid coil. The other side of the solenoid coil is connected to the limit switch 120 in order to complete a circuit. The circuit thus is formed from the positive terminal of the battery 118, through the throw and up pole of the operator 122, through the solenoid coil, through the limit switch 120 and back to the negative terminal of the battery 118. Thus, the solenoid coil lies in series with both the limit switch 120 and the operator up pole. Accordingly, in the illustrated embodiment, the solenoid will only be energized when both the limit switch 120 is closed and the throw of the operator 122 is placed in contact with the up pole.

The limit switch 120 is arranged on the stern drive 10 to operate between the stationary gimbal housing 16 and the drive housing 14. The position of the switch 120 is such that the switch is open when the tilt and trim adjustment system 12 positions the drive housing 14 within the trim range X, and is closed when the tilt and trim adjustment system 12 positions the drive housing 14 within the tilt range Y.

The up pole of the tilt and trim control operator 122 is also coupled to the motor of the hydraulic pump 40 (FIG. 2). For instance, the up pole, as well as the down pole, can be connected to a relay that controls the direction of current flow through the pump motor. By moving the throw of the operator 122 between the up and down poles, the relay reverses the direction in which the pump 40 runs.

The operation of the tilt and trim adjustment system 12 will now be described with reference to FIGS. 1–5. To raise the stern drive 10, the operator 122 is moved to connect the battery 118 to the up pole. As a result, the pump 40 runs in a first direction (i.e., under an up operational mode). The limit switch 120 though remains open when the stern drive moves upward within the trim range X. The solenoid 114 therefore is de-energized and the bypass valve 76 resides in its normal first position.

The pump 40 supplies pressurized working fluid to the up chambers 42 of the cylinders 26 via the flow control mechanism 70 when raising the stern drive 10. The pump 40 is run in a first direction under the up operational mode to pressurize the first fluid delivery line 66. The pump 40 pressurizes the up chamber B within the main valve 72 to open the check valve 82 to supply pressurized working fluid to the pressure line 88. The pump 40 also opens the second check valve 84 by pressurizing the up chamber B. The valve shuttle 78 slides towards the second check valve 84. The projection 87 of the valve shuttle 78 opens the second check valve 84. As a result, working fluid from the down chambers 44 of the cylinders 86 flows through the pressure line 58, through the bypass valve 76, which resides in the normal first position, through the pressure line 90 and through the second check valve 84 and down chamber C of the main valve 72 to the pump 40. In this manner, the pump 40 moves the working fluid from the down chambers 44 of the cylinders to the up chambers 42. In addition, the pump 40 may draw additional working fluid from the sump 60 through the check valve 62 in the pick up line. The pump 40 delivers the working fluid through the pressurized lines 88 to the up chambers 42 of the cylinders 26.

The actuator rods 30 extend from the cylinders 26 as the pressurized fluid fills the cylinder up chambers 42. The extension of the actuator rods 30 causes the stern drive outer housing 14 to rotate about the lateral pivot axis 18. The stern drive 10 swings through the trim range X as the cylinders 26 extend.

The outer housing 14 causes the limit switch 120 to close when the stern drive 10 reaches the fully-trimmed up position (TU). The limit switch 120 thus closes the electrical circuit to energize the solenoid coil and actuate the bypass valve 76. The energized solenoid 114 causes the lever 106 to move from the first position (as seen in FIG. 3) to the second position (as seen in FIG. 4). The pressure line 58, which is connected to the down chambers 44 of the cylinders 26, now communicates with the bypass line 74 with the valve 76 located in the second position. The pump 40 must now draw working fluid from the sump 60 through the pick-up line of the suction side of the pump 40.

The working fluid in the down cylinder chambers 44 flows through the bypass line 74 to the up cylinder chambers 42 in the present hydraulic circuit, rather than to the pump 40. The pressure produced by the corresponding movement of the pistons 46, 48 provides the motivating force to produce this flow and shunt the working fluid to the up chambers 42 of the cylinders 26. The cylinders 26 can rise quicker as a result of the "short circuit" provided by the open bypass lines 74.

The pump 40 operates in reverse (i.e., in an opposite operational mode) to lower the stern drive unit 10. For this purpose, the throw of the tilt and trim control operator 122 is placed in contact with the down pole. Notably, the positive terminal of the battery 118 is not connected to the solenoid coil under this mode of operation. The solenoid circuit thus is always open when lowering the stern drive 10 regardless of whether of the limit switch 120 is open or closed. The bypass valve 76 thus remains in the normal first position, placing the pressure line 90 in communication with the pressure line 58, and closing the bypass line 74. The bypass valve 78 remains in this position during both the tilt-down and trim-down operations, i.e., when the stern drive 10 is lowered through both the tilt range Y and the trim range X.

Assuming that the stern drive is in a raised position (in the fully-tilted up position FU), the pistons 46, 48 of each cylinder 26 lies away from the corresponding fluid port in the up chamber 42. If the operator decides to trim or tilt the stern drive 10 down, the electric motor (not shown) is energized so as to drive the pump 40 in a direction that pressurizes the second delivery line 68 and causes the first delivery line 66 to function as a pump return line. Under this operational mode, the pressurized fluid supplied by the pump 40 causes the flow control mechanism 70 to assume a second operational state, as described below. Pressure in the first pressure line 88 will also be created by the weight of the stern drive 10 and by any stress produced by the stern drive 10 during the trim-down operation.

When the second delivery line 86 is pressurized, the pressure chamber C of the shuttle valve assembly 72 shifts the shuttle 78 toward the first pressure chamber passage thereby opening the first check valve 82. The pressure in the chamber C is also sufficient to unseat the second check valve 84, thus allowing fluid to flow from the chamber C, through the second passage in the main body of the valve 72 and then to the pressure lines 90, 58 connected to the down chambers 44 of the cylinders 26. The valve 76 resides in its first operational position with the flow control mechanism 70 in this operational state, as noted above. Accordingly, the pistons 46, 48 are forced downward toward a lower end of the respective cylinder 26 to tilt or trim down the stern drive 10.

During downward movement of the free and active pistons 46, 48, a quantity of fluid is expelled from within the up cylinder chamber 42 of each cylinder 26 through a respective port to the pressure line 56. The fluid is delivered to the pump through the first pressure line 88 and through the check valve 82, which the valve shuttle 78 opens. The working fluid flows through the check valve 82 through the chamber B of the valve 72 and to the pump through the first delivery line 66.

The present tilt and trim adjustment system 12 thus allows the stern drive 10 to be quickly raised during tilt-up operations by opening the bypass line 72 between the chambers 42, 44 of the cylinders 26. The bypass line 72, however, is closed when raising the stern drive 10 in the trim range X as well as when lowering the stern drive 10 in order to provide greater control and ease adjustment of the stern drive within these ranges of movement.

The operation of the bypass valve 76 also occurs automatically. The boat operator need not actuate an additional operator to quickly raise the stern drive unit 10. Rather, the tilt and trim adjustment system 12 self acts to increase the rate at which the stern drive rises when the stern drive 10 moves into and through the tilt up range Y. In the illustrated embodiment, the rise rate of the stern drive 10 through the tilt range Y desirably is at least 1.5 times greater than the rise rate of the stern drive 10 when moved in the trim range X.

Figure 6:
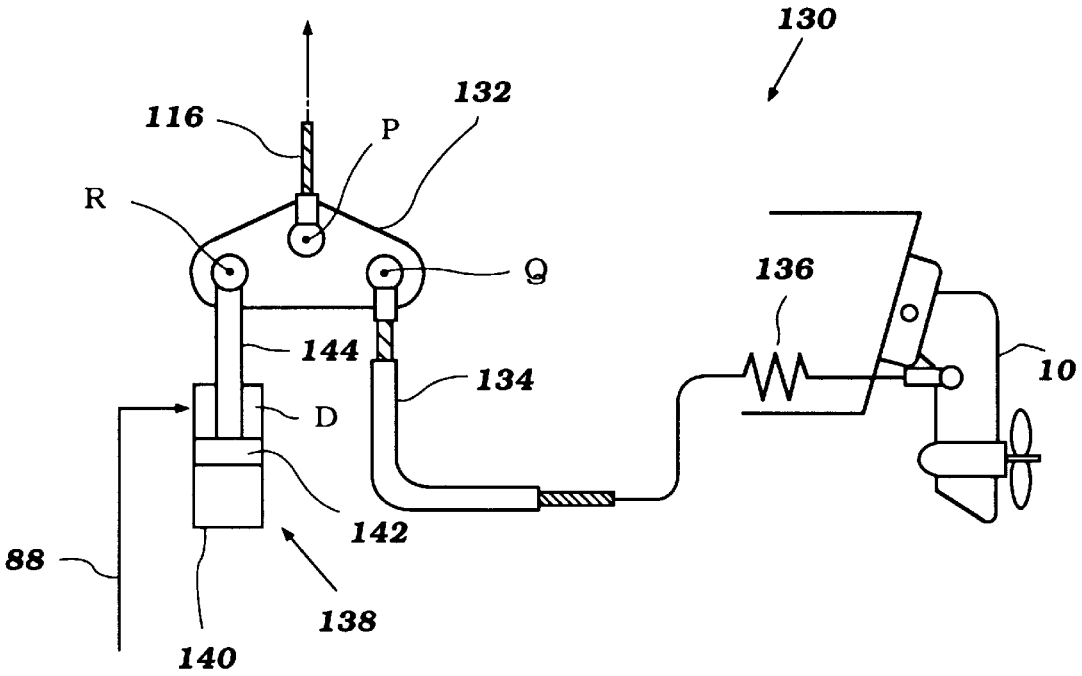
FIG. 6 schematically illustrates an actuator mechanism configured in accordance with another preferred embodiment of the present invention, and shows the actuator mechanism in use with an exemplary stern drive.

FIG. 6 illustrates another embodiment of an actuator system 130 that can be used with the present tilt and trim adjustment system 12. The illustrated actuator system 130 desirably causes the bypass valve 76 to toggle between the first and second positions to open and close the bypass line 74 depending in part upon the angular orientation of the stern drive 10. In the illustrated embodiment, the actuator system 130 opens or closes the valve 76 depending upon whether the tilt and trim adjustment system 12 moves the stern drive 10 upward through the tilt range Y, or whether the actuator system 12 moves the stern drive 10 upward through the trim range X (see FIG. 1).

As seen in FIG. 6, the actuator system 130 includes a link 132 connected to the coupler 110 via the linkage 116. An end of the linkage 116 is pivotally coupled to the link 132 at a first point P on the link 132.

Another linkage connects the link 132 to the stern drive 10. In the illustrated embodiment, this linkage comprises a bowden-wire like cable 134. One end of the cable 134 is pivotally connected to the link 132 at a point Q. The linkage also includes a lost motion mechanism 136 in order to provide relative movement of the stern drive 10 without imparting movement to the cable 134 during at least some portion of the drive's tilt and trim travel. In the present embodiment, this lost motion mechanism takes the form of an expansion spring.

The actuator system 130 also includes a slave device 138 that tracks the movement of the stern drive 10 through the trim range X, but does not track the movement of the stern drive 10 within the tilt range Y. In the illustrated embodiment, the slave device 138 comprises a cylinder 140 in which a piston 142 slides. A linkage rod 144 connects the piston 142 to the link 132 via a pivotal connection. As seen in FIG. 6, the linkage rod 144 is connected to the link 132 at point R. Point R is positioned on the link 132 so as to position the attachment point P of the linkage 116 between the attachment points Q and R of the linkage 134 and the actuator rod 144, respectively.

As understood from FIGS. 2 and 6, the first pressure line 88 is also connected to the cylinder 140 of the slave device and communicates with a chamber D through which the linkage rod 144 passes. The chamber D desirably is expandable by movement of the piston 142. The stroke of the piston 142 desirably matches that of the movement of the stern drive 10 through the trim range X.

When the tilt and trim actuator mechanism 12 raises the stern drive 10, the pump 40 pressurizes the up chambers 42 of the cylinders 26 to raise the stern drive, as well as pressurizes the chamber D of the slave cylinder 140. The degree of movement of the slave piston 142 desirably correlates to the movement of the pistons 46, 48 of the cylinders 26 such that the piston 142 moves from a location that corresponds to the stern drive 10 in a fully-trimmed down position TD to a fully-trimmed up position TU. The piston 142 bottoms against the end of the cylinder 142 when the stern drive 10 is raised to the fully-trimmed up position TU.

The operation of the actuator system 130 will now be described in principal reference to FIG. 6. To raise the stern drive 10 within the trim range X, the flow control mechanism 70 and the pump 40 function in a manner described above to supply pressurized working fluid through the up chambers 42 of the cylinders 26 to raise the stern drive 10. The working fluid within the down chamber 44 of the cylinders is returned to the pump 40 also in the manner described above. In addition, during outward movement of the stern drive 10, the pump also supplies pressurized fluid through the first pressure line 88 to the slave cylinder 140. The piston 142 thus tracks the movement of the actuator cylinder pistons 146, 148, as described above. During this operation, the actuator rod 144 follows the movement of the piston 142 and causes the link 132 to rotate about point P. The linkage cable 134 thus moves relative to the stern drive 110; however, the lost motion connection 136 between the cable 134 and the stern drive 10 allows for this relative movement without interfering with the upward trim movement of the stern drive 10.

A fixation device desirably holds the valve 76 within its first position during this operation. The fixation device can be a conventional detent mechanism that holds the valve 76 in the first position when the tilt and trim adjustment systern 12 raises the stern drive 10 within the trim range X. Alternatively, the valve may include enough internal friction to provide the holding capability of the valve during this range of movement. In either event, the point of attachment P of the linkage 116 remains substantially stationary and provides the fulcrum about which the link 132 pivots.

The slave piston 142 bottoms against the cylinder 140 when the stern drive 10 reaches a fully-trimmed up position TU. Further upward movement of the stern drive 10 into and through the tilt range Y causes the link 132 to rotate about the attachment point R. The linkage 134 moves together with the drive 10 as the lost motion connection 136 desirably is configured to directly communicate the drive's movement to the linkage 134 at this point in the drive's travel. For instance, in the illustrated embodiment, the spring 136 can have a sufficiently large spring constant so as not to expand under the tensile force occurring with the linkage 134 during this operation. The movement of the stern drive 10 thus is directly transferred to the cable 134. In this manner, the point of attachment Q to which the cable 134 is connected to the link 132 moves with the stern drive and rotates about attachment point R, now stationary. The force applied to the link 132 by the cable 134 as the stern drive rises in the tilt range Y is sufficient to overcome the forces holding the bypass valve 76 in the first position. The linear movement of the cable 134 imparted to the linkage 116 through the link 132 causes the valve 76 to rotate into the second position. The lost motion connection 136 then permits additional movement of the stern drive unit relative to point Q on the link 132 as the tilt and trim adjustment systern 12 moves the stern drive 10 through the tilt range up to the fully-tilted up position (FU).

A biasing mechanism (not shown) desirably operates to bias the bypass valve 76 to the first position. The biasing mechanism biases the bypass valve 76 back into the first position when lowering the stern drive, both through the tilt range Y and the trim range X. Without the pressure supplied by the pump in chamber D, the biasing mechanism can pull the link 132 back into a position that corresponds with the first position of the valve 76.

Thus as is common to both embodiments, the tilt and trim adjustment systern 12 automatically functions to quicken the rise rate of the stern drive 10 when raising it within the tilt range Y. The systern 12, however, resets itself so as to lower the stern drive, as well as raise the stern drive within the trim range X, at a slower rate. The adjustment systern 12 thus adds versatility to the drive unit, giving it the operating characteristics desired in both leisure and commercial applications. The systern can also be easily retrofitted to existing drive without substantially modifying the drive or the associated control systern.

Although this invention has been described in terms of certain preferred embodiments, other embodiments apparent to those of ordinary skill in the art are also within the scope of this invention. Accordingly, the scope of the invention is intended to be defined only by the claims that follow.

What is Claimed is:

1. A tilt and trim adjustment systern for an outboard drive to raise and lower the outboard drive through a tilt and trim range of movement, the adjustment systern comprising at least one cylinder connected to the outboard drive, the cylinder including first and second chambers, a pump connected to each of the first and second cylinder chambers by a first pressure line and a second pressure line respective, to supply pressurized working fluid to the cylinder chambers, a first valve disposed within the first pressure line and a second valve disposed within the second pressure line to regulate flow through the respective pressure line, a bypass line interconnecting the first and second cylinder chambers independent of the pump and of the first and second valves, and a bypass valve operating between the cylinder chambers and communicating with the bypass line to selectively permit fluid communication between the cylinder chambers through the bypass line, the bypass valve operating between at least a first operational state, in which the bypass valve permits fluid flow through the bypass line, and a second operational state, in which the bypass valve arrests fluid flow through the bypass line, and an actuator mechanism which automatically moves the bypass valve into one of the two operational states depending upon a tilt/trim angle of the outboard drive.

2. A tilt and trim adjustment systern as in claim 1, wherein the actuator mechanism includes a sensing device coupled to the outboard drive.

3. A tilt and trim adjustment systern as in claim 2, wherein the sensing device comprises a switch, and the actuator mechanism includes a solenoid placed in series with the switch, and the switch operates between an open position and closed position depending upon the tilt/trim angle of the outboard drive.

4. A tilt and trim adjustment systern as in claim 3, wherein the switch is a limit switch and is arranged to close when the tilt and trim adjustment systern raises the outboard drive from a trim movement range into a tilt movement range, and to open when the tilt and trim adjustment systern lowers the outboard drive from the tilt movement range to the trim movement range.

5. A tilt and trim adjustment systern as in claim 2, wherein the sensing device comprises a linkage that is mechanically connected to the outboard drive.

6. A tilt and trim adjustment systern as in claim 5, wherein the linkage comprises a flexible cable.

7. A tilt and trim adjustment systern as in claim 5, wherein the linkage additionally comprises a lost motion mechanism that operates between the outboard drive and the bypass valve.

8. A tilt and trim adjustment systern as in claim 1, wherein the actuator mechanism is coupled to the pump and to the outboard drive, in addition to the valve.

9. A tilt and trim adjustment systern as in claim 8, wherein the actuator mechanism comprises a link, the pump being coupled to the link at first point, the valve being coupled to the link at a second point, and the outboard drive being coupled to the link at a third point.

10. A tilt and trim adjustment systern as in claim 1, wherein the actuator mechanism comprises means for establishing the bypass valve in the first operational state when the tilt and trim adjustment systern raises the outboard drive from a trim movement range into a tilt movement range, and for establishing the bypass valve in the second operational state when the tilt and trim adjustment systern lowers the outboard drive from the tilt movement range to the trim movement range.

11. A tilt and trim adjustment systern as in claim 1 additionally comprising a manual override mechanism that communicates with each of the cylinder chambers.

12. A tilt and trim adjustment systern as in claim 11, wherein the manual override mechanism comprises a common return line arranged between the cylinder chambers and in parallel to the bypass line, the return line communicating with a sump, a manual override valve operating between the return line and the sump, and a plurality of check valves positioned within the return line, each check valve operating between the sump and one of the cylinder chambers.

13. A tilt and trim adjustment systern as in claim 1, wherein the cylinder additionally comprises a rod that extends with the pump operating under a first mode of operation and the bypass valve operating in the first operational state.

14. A tilt and trim adjustment systern as in claim 13, wherein the cylinder rod retracts with the pump operating under a second mode of operation and the bypass valve operating in the second operational state.

15. A tilt and trim adjustment systern for an outboard drive to raise and lower the outboard drive through tilt and trim ranges, comprising at least one cylinder connected to the outboard drive, the cylinder including first and second chambers, a pump connected to each of the first and second cylinder chambers by a first pressure line and a second pressure line, respectively, to supply pressurized working fluid to the cylinder chambers, a first valve disposed within the first pressure line and a second valve disposed in the second pressure line to regulate flow through the respective pressure line, a bypass line interconnecting the first and second cylinder chambers independent of the pump and of the first and second valves, and means for permitting fluid flow through the bypass line and between the cylinder chambers when moving the outboard drive within the tilt range, and for inhibiting fluid flow through the bypass line and between the cylinder chambers when moving the outboard drive within the trim range.

16. A tilt and trim adjustment systern for an outboard drive to raise and lower the outboard drive through a tilt and trim range of movement, the adjustment systern comprising at least one cylinder connected to the outboard drive, the cylinder including first and second chambers, a pump connected to each of the first and second cylinder chambers by a first pressure line and a second pressure line, respective, to supply pressurized working fluid to the cylinder chambers, a first valve disposed within the first pressure line and a second valve disposed in the second pressure line to regulate flow through the respective pressure line, a bypass line interconnecting the first and second cylinder chambers independent of the pump, and a bypass valve operating independent of the first and second valves, the bypass valve being disposed between the bypass line and the first pressure line to selectively permit fluid communication between the cylinder chambers through the bypass line, the bypass valve operating between at least a first operational state, in which the bypass valve permits fluid flow through the bypass line and arrests fluid flow through at least a portion of the first pressure line that extends between the bypass valve and the first valve, and a second operational state, in which the bypass valve arrests fluid flow through the bypass line and permits fluid flow through the first pressure line, and an actuator mechanism which automatically moves the bypass valve into one of the two operational states depending upon a tilt/trim angle of the outboard drive.

17. A tilt and trim adjustment systern as in claim 16, wherein the actuator mechanism includes a sensing device coupled to the outboard drive.

18. A tilt and trim adjustment systern as in claim 17, wherein the sensing device comprises a switch, and the actuator mechanism includes a solenoid placed in series with the switch, and the switch operates between an open position and closed position depending upon the tilt/trim angle of the outboard drive.

19. A tilt and trim adjustment systern as in claim 18, wherein the switch is a limit switch and is arranged to close when the tilt and trim adjustment systern raises the outboard drive from a trim movement range into a tilt movement range, and to open when the tilt and trim adjustment systern lowers the outboard drive from the tilt movement range to the trim movement range.

20. A tilt and trim adjustment systern as in claim 17, wherein the sensing device comprises a linkage that is mechanically connected to the outboard drive.

21. A tilt and trim adjustment systern as in claim 20, wherein the linkage comprises a flexible cable.

22. A tilt and trim adjustment systern as in claim 21, wherein the linkage additionally comprises a lost motion mechanism that operates between the outboard drive and the bypass valve.

23. A tilt and trim adjustment systern as in claim 16, wherein the actuator mechanism is coupled to the pump and to the outboard drive, in addition to the valve.

24. A tilt and trim adjustment systern as in claim 23, wherein the actuator mechanism comprises a link, the pump being coupled to the link at first point, the valve being coupled to the link at a second point, and the outboard drive being coupled to the link at a third point.

25. A tilt and trim adjustment systern for an outboard drive to raise and lower the outboard drive through a tilt and trim range of movement, the adjustment systern comprising at least one cylinder connected to the outboard drive, the cylinder including first and second chambers, a pump connected to each of the first and second cylinder chambers by a first pressure line and a second pressure line, respective, to supply pressurized working fluid to the cylinder chambers, a first valve disposed within the first pressure line and a second valve disposed in the second pressure line to regulate flow through the respective pressure line, a bypass line interconnecting the first and second cylinder chambers independent of the pump, and a rotational bypass valve operating between the cylinder chambers and communicating with the bypass line to selectively permit fluid communication between the cylinder chambers through the bypass line, the bypass valve operating between at least a first operational state, in which the bypass valve permits fluid flow through the bypass line, and a second operational state, in which the bypass valve arrests fluid flow through the bypass line, and an actuator mechanism which automatically moves the bypass valve into one of the two operational states depending upon a tilt/trim angle of the outboard drive.

26. A tilt and trim adjustment systern as in claim 25, wherein the actuator mechanism includes a sensing device coupled to the outboard drive.

27. A tilt and trim adjustment systern as in claim 26, wherein the sensing device comprises a switch, and the actuator mechanism includes a solenoid placed in series with the switch, and the switch operates between an open position and closed position depending upon the tilt/trim angle of the outboard drive.

28. A tilt and trim adjustment systern as in claim 27, wherein the switch is a limit switch and is arranged to close when the tilt and trim adjustment systern raises the outboard drive from a trim movement range into a tilt movement range, and to open when the tilt and trim adjustment systern lowers the outboard drive from the tilt movement range to the trim movement range.

29. A tilt and trim adjustment systern as in claim 26, wherein the sensing device comprises a linkage that is mechanically connected to the outboard drive.

30. A tilt and trim adjustment systern as in claim 29, wherein the linkage comprises a flexible cable.

31. A tilt and trim adjustment systern as in claim 30, wherein the linkage additionaly comprises a lost motion mechanism that operates between the outboard drive and the bypass valve.

32. A tilt and trim adjustment systern as in claim 25, wherein the actuator mechanism is coupled to the pump and to the outboard drive, in addition to the valve.

33. A tilt and trim adjustment systern as in claim 32, wherein the actuator mechanism comprises a link, the pump being coupled to the link at first point, the valve being coupled to the link at a second point, and the outboard drive being coupled to the link at a third point.

34. A tilt and trim adjustment systern as in claim 25 additionally comprising a main valve assembly arranged between the cylinder and the pump and selectively placing the pump in communication with at least one of the cylinder chambers.

* * * * *

UNITED STATES PATENT AND TRADEMARK OFFICE

CERTIFICATE OF CORRECTION

PATENT NO. : 6,048,234
DATED : April 11, 2000
INVENTOR(S) : Uematsu et al.

It is certified that error appears in the above-identified patent and that said Letters Patent is hereby corrected as shown below:

Column 12, claim 10,
Line 51, "systern" should be -- system --.

Signed and Sealed this

Nineteenth Day of March, 2002

*Attest:*

*Attesting Officer*

JAMES E. ROGAN
*Director of the United States Patent and Trademark Office*